US009195203B2

(12) United States Patent
Akamatsu et al.

(10) Patent No.: US 9,195,203 B2
(45) Date of Patent: Nov. 24, 2015

(54) DEVELOPING DEVICE AND IMAGE FORMING APPARATUS INCLUDING CLEANING MEMBER AND CLEANING MEMBER

(71) Applicant: FUJI XEROX CO., LTD., Minato-ku, Tokyo (JP)

(72) Inventors: Hiroaki Akamatsu, Kanagawa (JP); Noriaki Kojima, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/450,313

(22) Filed: Aug. 4, 2014

(65) Prior Publication Data

US 2015/0277342 A1 Oct. 1, 2015

(30) Foreign Application Priority Data

Mar. 25, 2014 (JP) ..... 2014-061952

(51) Int. Cl.
*G03G 21/00* (2006.01)

(52) U.S. Cl.
CPC ..... *G03G 21/0017* (2013.01)

(58) Field of Classification Search
CPC ..... G03G 21/0011; G03G 21/0017
USPC ..... 399/350
See application file for complete search history.

(56) References Cited

U.S. PATENT DOCUMENTS

| | | | | |
|---|---|---|---|---|
| 8,275,302 | B2 * | 9/2012 | Sako et al. | 399/350 |
| 8,594,552 | B2 * | 11/2013 | Yamamoto et al. | 399/350 |
| 8,712,309 | B2 * | 4/2014 | Watanabe et al. | 399/350 |
| 8,798,516 | B2 * | 8/2014 | Okamoto et al. | 399/350 |
| 8,983,336 | B2 * | 3/2015 | Kojima et al. | 399/350 |

FOREIGN PATENT DOCUMENTS

| | | | |
|---|---|---|---|
| JP | 2009-300551 | A | 12/2009 |
| JP | 2010-66333 | A | 3/2010 |

* cited by examiner

*Primary Examiner* — William J Royer
(74) *Attorney, Agent, or Firm* — Sughrue Mion, PLLC

(57) ABSTRACT

A cleaning member includes a body and an edge. The body has rubber hardness of about 68 to 75 degrees and is fixed to a support member at one end of the body. The body has a plate-like shape in which a corner portion of the body is missing. The edge is provided at the corner portion and fits into it. The edge is in contact with a subject to be cleaned and has a thickness of about 0.1 to 1 mm. The cleaning member satisfies the following conditions:

$80 \leq y \leq 90$;

$y \geq -40x+95$; and $y \leq -40x+110$ where x denotes a ratio of a length of the edge in a predetermined direction to a length of a portion of the body which is not fixed to the support member in the predetermined direction, and y denotes rubber hardness of the edge.

3 Claims, 4 Drawing Sheets

DEVELOPING DEVICE AND IMAGE FORMING APPARATUS INCLUDING CLEANING MEMBER AND CLEANING MEMBER

CROSS-REFERENCE TO RELATED APPLICATIONS

This application is based on and claims priority under 35 USC 119 from Japanese Patent Application No. 2014-061952 filed Mar. 25, 2014.

BACKGROUND

Technical Field

The present invention relates to a cleaning member, a developing device, and an image forming apparatus.

SUMMARY

According to an aspect of the invention, there is provided a cleaning member including a body and an edge. The body has rubber hardness of about 68 to 75 degrees and is fixed to a support member at one end of the body. The body has a plate-like shape in which a corner portion of the body is missing. The edge is provided at the corner portion and fits into it. The edge is in contact with a subject to be cleaned and has a thickness of about 0.1 to 1 mm. The cleaning member satisfies the following conditions:

$$80 \leq y \leq 90;$$

$$y \geq -40x+95; \text{ and}$$

$$y \leq -40x+110$$

where x denotes a ratio of a length of the edge in a predetermined direction to a length of a portion of the body which is not fixed to the support member in the predetermined direction, and y denotes rubber hardness of the edge.

BRIEF DESCRIPTION OF THE DRAWINGS

An exemplary embodiment of the present invention will be described in detail based on the following figures, wherein.

DETAILED DESCRIPTION

1. Exemplary Embodiment

Figure 1:
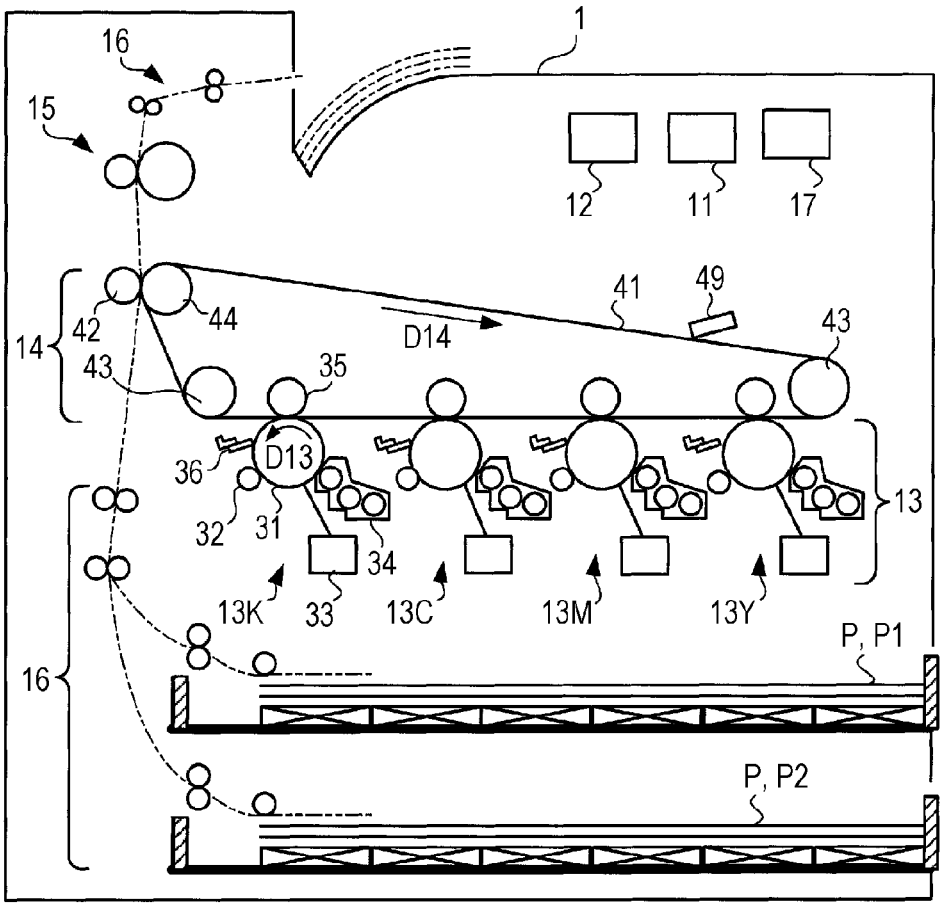
FIG. 1 illustrates the overall configuration of an image forming apparatus.

FIG. 1 illustrates the overall configuration of an image forming apparatus 1 according to an exemplary embodiment of the present invention. The image forming apparatus 1 forms images by using an electrophotographic system. The image forming apparatus 1 is a so-called tandem image forming apparatus and forms an image on a sheet P, which is an example of a recording medium, on the basis of image data representing an image. A controller 11 includes a central processing unit (CPU), a read only memory (ROM), and a random access memory (RAM). The CPU reads a computer program (hereinafter simply referred to as a "program") stored in the ROM or a storage device 12 and executes the program, thereby controlling the individual elements of the image forming apparatus 1. The storage device 12 is a large-capacity memory, such as a hard disk drive, and stores therein the program read by the CPU of the controller 11. An operation device 17 includes operation buttons for inputting various instructions. The operation device 17 receives an operation performed by a user and supplies a signal indicating the content of the operation to the controller 11.

Developing devices 13Y, 13M, 13C, and 13K form toner images on the sheet P, Y, M, C, and K appended to the reference numeral represent the colors of toner, that is, yellow, magenta, cyan, and black, respectively. Although the developing devices 13Y, 13M, 13C, and 13K utilize different colors of toners, there is no great difference in the configuration between them. Hereinafter, the developing devices 13Y, 13M, 13C, and 13K will be referred to as the "developing device 13" by omitting the alphabetical characters appended to the reference numeral unless it is necessary to particularly distinguish between them. The developing device 13 is an example of a developing device according to an exemplary embodiment of the invention.

Each developing device 13 includes a photoconductor drum 31, a charging unit 32, an exposure unit 33 (an example of an exposure unit according to an exemplary embodiment of the invention), and a developing unit 34 (an example of a developing unit according to an exemplary embodiment of the invention), a first transfer roll 35, and a drum cleaner 36. The photoconductor drum 31 is an image carrier including a charge generating layer and a charge transport layer, and is rotated by a driver (not shown) in a direction indicated by the arrow D13 shown in FIG. 1. The charging unit 32 charges the surface of the photoconductor drum 31. The exposure unit 33 includes, for example, a laser emitting source and a polygon mirror (neither of them is shown), and applies laser light corresponding to image data to the photoconductor drum 31 charged by the charging unit 32, under the control of the controller 11. With this operation, a latent image is formed on each photoconductor drum 31. The above-described image data may be data obtained by the controller 11 from an external device via a communication unit (not shown). The external device is, for example, a reader for reading an original image or a storage device storing therein data indicating an image.

In the developing unit 34, a two-component developer including one of Y, M, C, and K toners and a magnetic carrier, such as ferrite powder, is stored. The head of a magnetic brush formed in the developing unit 34 is brought into contact with the surface of the photoconductor drum 31, and then, the toner adheres to a portion exposed to light by the exposure unit 33, that is, the line portion of an electrostatic latent image, on the surface of the photoconductor drum 31, thereby forming (developing) an image on the photoconductor drum 31. The first transfer roll 35 generates a predetermined potential difference at a position at which an intermediate transfer belt 41 of a transfer unit 14 opposes the photoconductor drum 31, and transfers the image formed on the photoconductor drum 31 to the intermediate transfer belt 41 by using this potential difference. The drum cleaner 36 removes toner remaining on the surface of the photoconductor drum 31 after the image has been transferred to the intermediate transfer belt 41. That is, the drum cleaner 36 removes unnecessary toner from the photoconductor drum 31 for the formation of a subsequent image.

The transfer unit 14 (an example of a transfer unit according to an exemplary embodiment of the invention) includes the intermediate transfer belt 41, a second transfer roll 42, belt transport rolls 43, and a backup roll 44, and transfers an image formed by the developing device 13 to a sheet P of a type determined through an operation performed by a user. The intermediate transfer belt 41 is an endless belt member, and the belt transport rolls 43 and the backup roll 44 stretch the intermediate transfer belt 41 therebetween. At least one of the belt transport rolls 43 and the backup roll 44 includes a driver (not shown), and moves the intermediate transfer belt 41 in a direction indicated by the arrow D14 in FIG. 1. The belt transport rolls 43 or the backup roll 44 that does not have a driver is driven and rotated in accordance with the movement of the intermediate transfer belt 41. The intermediate transfer belt 41 is moved and rotated in the direction indicated by the arrow D14 in FIG. 1, thereby transporting the image on the intermediate transfer belt 41 to a region sandwiched between the second transfer roll 42 and the backup roll 44.

The second transfer roll 42 transfers the image on the intermediate transfer belt 41 to a sheet P transported from a transport unit 16 by using a potential difference with the intermediate transfer belt 41. A belt cleaner 49 removes toner remaining on the surface of the intermediate transfer belt 41 that has not been transferred. The transfer unit 14 or the transport unit 16 transports the sheet P to which the image has been transferred to a fixing unit 15.

The fixing unit 15 fixes the image transferred to the sheet P by heating. The transport unit 16 includes containers and transport rolls. In the containers, sheets P which are cut in a predetermined size in advance and to which an image on the intermediate transfer belt 41 will be transferred and be fixed by heating are stored. Sheets P are an example of a recording medium. Concerning the sizes of sheets P, at least two different sizes in a direction perpendicular to the transport direction of sheets P, that is, in the widthwise direction, are determined. In this case, two types of sheets P, such as largest-width sheets P1 having the largest width and smaller-width sheets P2 having a width smaller than that of the largest-width sheets P1 are used. The largest-width sheets P1 are sheets having the largest width among sheets P handled in the image forming apparatus 1. These two types of sheets P are distinguished from each other by the controller 11 identifying the containers. Sheets P stored in each container are extracted one by one by the transport rolls in response to an instruction from the controller 11, and are transported to the transfer unit 14 via a sheet transport path. A recording medium is not restricted to a sheet of paper, and may be, for example, a resin sheet. In short, any type of recording medium may be used as long as an image can be formed on the surface of the recording medium.

Figure 2:
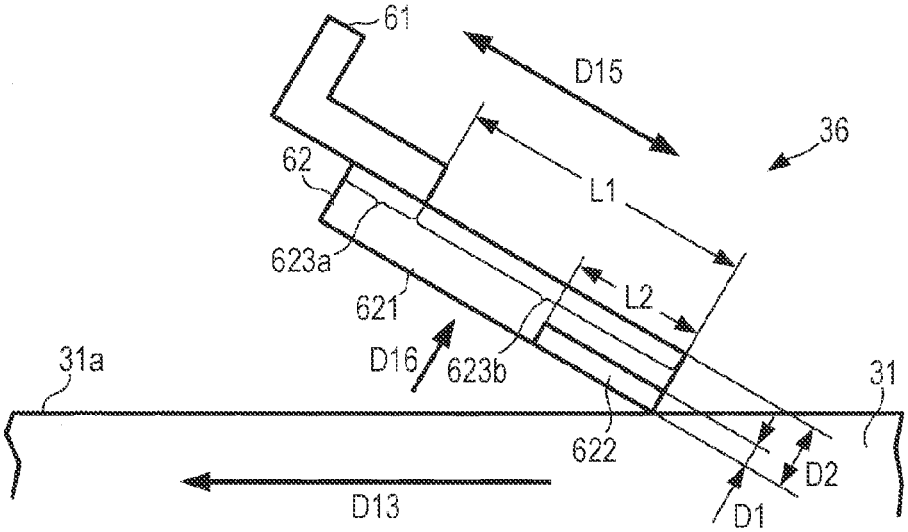
FIG. 2 illustrates an example of the configuration of a drum cleaner.

FIG. 2 illustrates an example of the configuration of the drum cleaner 36, as viewed from a direction parallel with the rotational axis of the photoconductor drum 31. The drum cleaner 36 includes a support member 61 and a cleaning blade 62. The support member 61 supports the cleaning blade 62. The support member 61 is fixed to a housing (not shown) of the image forming apparatus 1. The cleaning blade 62 is an example of a cleaning member according to an exemplary embodiment of the invention.

Figure 3:
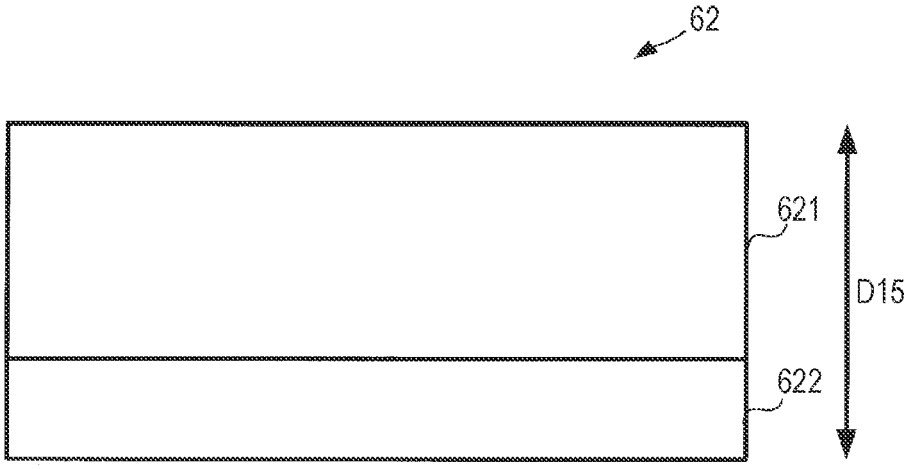
FIG. 3 illustrates a cleaning blade, as viewed from a direction indicated by the arrow D16.

FIG. 3 illustrates the cleaning blade 62, as viewed from a direction indicated by the arrow D16 in FIG. 2. As shown in FIGS. 2 and 3, the cleaning blade 62 is a plate-like member extending in a direction indicated by the bidirectional arrow D15 in FIGS. 2 and 3. The cleaning blade 62 is made of rubber and includes a body 621 and an edge 622. The body 621 and the edge 622 are made of different materials. The body 621 is preferably made of a material having rubber hardness of about 68 to 75 degrees. The rubber hardness is defined by JIS K 6253 type A, and is measured by, for example, durometer MD-1 made by KOBUNSHI KEIKI CO., LTD. The thickness D2 of the body 621 is preferably about 1.5 to 2.5 mm. The body 621 is fixed at an end 623*a* to the support member 61. The end 623*a* is not deformed since it is fixed to the support member 61. In contrast, a non-fixed portion 623*b*, which is not fixed to the support member 61, is deformed by external pressure. In this example, the cleaning blade 62 contacts a surface 31*a* of the photoconductor drum 31 and is subjected to force applied from the surface 31*a*. The body 621 is formed in a shape from which part of a plate-like shape is missing. A portion missing in the body 621 is a portion including a side of the cleaning blade 62 which is in contact with the surface 31*a* of the photoconductor drum 31. The shape of this missing portion is, for example, a plate-like shape.

The edge 622 is formed in such a shape as to fit into the missing portion of the body 621. In this example, the edge 622 has a plate-like shape. By fitting the edge 622 into the missing portion of the body 621, the cleaning blade 62 is formed in a plate-like shape as a whole. In this example, the edge 622 is formed in a plate-like shape and a lateral side is rectangular. The thickness D1 of the edge 622 is preferably about 0.1 to 1 mm. In this example, the rubber hardness of the edge 622 is higher than that of the body 621.

In this example, a length from a boundary between one end of the non-fixed portion 623*b* and a fixed portion (end 623*a*) to the other end of the non-fixed portion 623*b*, that is, a length of the non-fixed portion 623*b* in the direction indicated by the bidirectional arrow D15 is referred to as a "free length L1". The direction indicated by the bidirectional arrow D15 is a direction perpendicular to the axis of the photoconductor drum 31 and is also parallel with a larger surface of two surfaces of the cleaning blade 62 which form an acute angle with the photoconductor drum 31. The width of the edge 622 in the direction indicated by the bidirectional arrow D15 is referred to as an "edge width L2". When the ratio of the edge width L2 to the free length L1 is indicated by x and when the rubber hardness of the edge 622 (edge hardness) is indicated by y, the ratio x and the edge hardness y satisfy all conditions represented by the following expressions (1) through (3).

$$80 \le y \le 90 \quad (1)$$

$$y \ge -40x + 95 \quad (2)$$

$$y \le -40x + 110 \quad (3)$$

If the ratio x increases, Young's modulus of the overall cleaning blade 62 increases. If the rubber hardness of the edge 622 increases, Young's modulus of the overall cleaning blade 62 increases. If Young's modulus of the overall cleaning blade 62 becomes excessively high, the cleaning blade 62 vibrates together with the rotation of the photoconductor drum 31, which may cause the occurrence of abnormal sound called "blade friction noise". On the other hand, if Young's modulus of the overall cleaning blade 62 becomes excessively low, the level by which the edge 622 of the cleaning blade 62 is deformed by tuck-under in accordance with the rotation of the photoconductor drum 31 increases, thereby increasing static torque of the photoconductor drum 31. Tuck-under means a blade failure mode wherein a frictional force on a blade tip generated by a photoconductor drum becomes high as to deform the blade tip substantially out of its normal cleaning position into a non-cleaning position. Static torque is resistance generated when the photoconductor drum 31 starts rotating from a state in which it is still. If static torque of the photoconductor drum 31 increases, the vibration of the edge 622 becomes nonuniform. This may cause uneven wear on the surface of the photoconductor drum 31.

If the edge hardness y becomes excessively high, the cleaning blade 62 is partially worn, thereby causing the occurrence of leakage of toner. Leakage of toner means that toner remaining on the surface of the photoconductor drum 31 that has not been transferred from the photoconductor drum 31 to the intermediate transfer belt 41 slips between the cleaning blade 62 and the photoconductor drum 31 and still remains on the surface of the photoconductor drum 31. Because of this leakage of toner, the charging unit 32 gets dirty, which may make the potential of the photoconductor drum 31 nonuniform. In contrast, if the edge hardness y becomes excessively low, the wear of the entirety of the cleaning blade 62 increases. This also causes leakage of toner.

The inventors of the invention of this application have fabricated samples of cleaning blades by changing the edge width and the edge hardness and have evaluated the samples in terms of static torque, blade friction noise, and wear. The dimensions and the rubber hardness of cleaning blades used as samples for evaluation are as follows: the free length L1 is 8 mm; the thickness D2 of the body 621 is 2 mm; the thickness D1 of the edge 622 is 0.4 mm; and the rubber hardness of the body 621 is 72 degrees. The edge hardness has been measured by durometer MD-1 made by KOBUNSHI KEIKI CO., LTD., as stated above.

Figure 4:
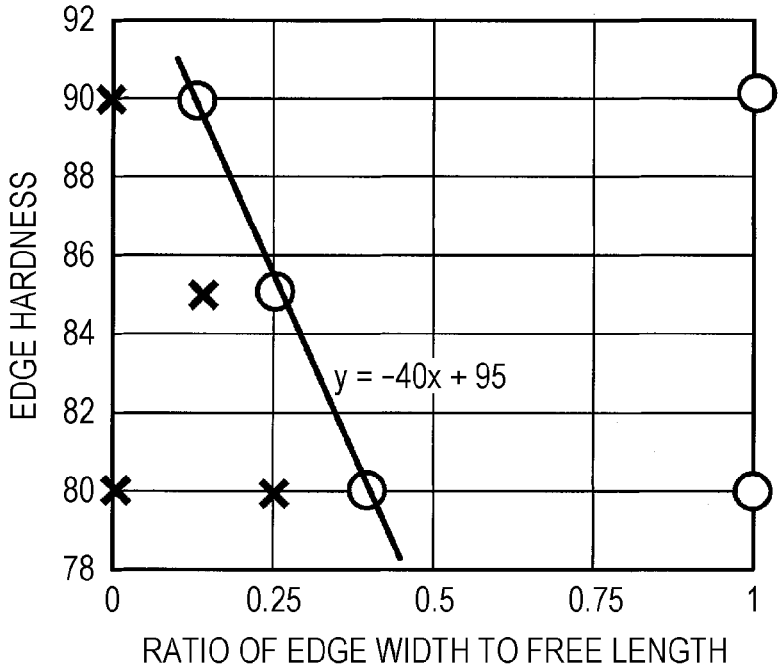
FIG. 4 is a graph illustrating results obtained by evaluating samples in terms of static torque of a photoconductor drum.

FIG. 4 is a graph illustrating results obtained by evaluating the samples in terms of static torque of the photoconductor drum 31. In FIG. 4, the horizontal axis indicates the ratio x (=L2/L1), and the vertical axis indicates the edge hardness y. The static torque generated as a result of continuously forming images on 500 blank sheets of paper by using each sample has been measured by using a torque gauge (BTG60CN made by TOHNICHI Mfg. CO., LTD.). As a result of evaluation, in FIG. 4, samples that have caused the generation of static torque of the photoconductor drum 31 which is equal to or lower than a target value are indicated by ○, while samples that have caused the generation of static torque which is greater than the target value are indicated by x. The target value of static torque is 40 cN·m.

The evaluation results of FIG. 4 show that, when the edge hardness y is smaller than $-40x+95$, the generated static torque does not satisfy the target value, that is, the static torque is greater than 40 cN·m.

Figure 5:
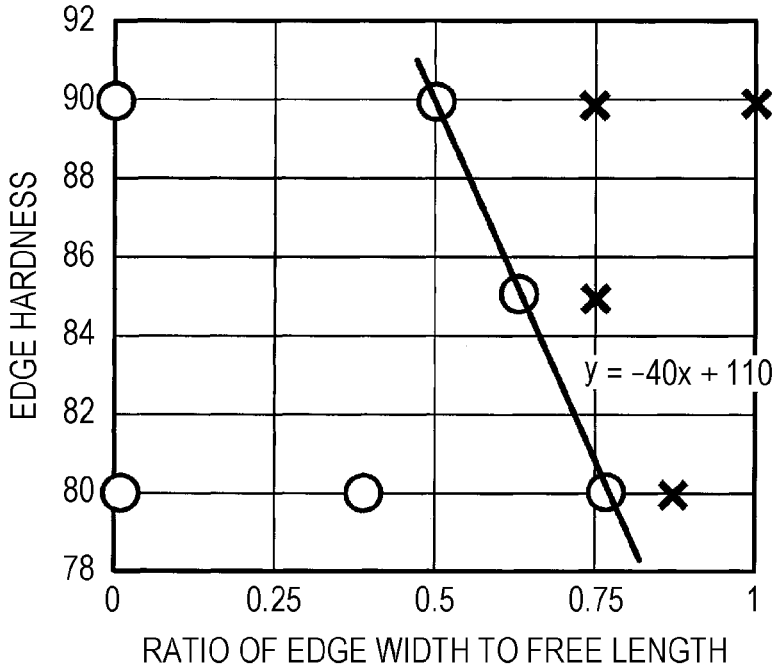
FIG. 5 is a graph illustrating results obtained by evaluating samples in terms of blade friction noise.

FIG. 5 is a graph illustrating results obtained by evaluating the samples in terms of blade friction noise. In FIG. 5, the horizontal axis indicates the ratio x (=L2/L1), and the vertical axis indicates the edge hardness y. An operator of this test has checked for the occurrence of blade friction noise as a result of continuously forming images on 500 blank sheets of paper by determining whether or not sound has been louder than the driving sound of a machine. As a result of checking, in FIG. 5, samples that have not caused the occurrence of blade friction noise are indicated by ○, while samples that have caused the occurrence of blade friction noise are indicated by x.

The evaluation results of FIG. 5 show that, when the edge hardness y is greater than $-40x+110$, the occurrence of blade friction noise is observed.

In addition to the evaluations shown in FIGS. 4 and 5, the inventors of the invention of this application have evaluated the samples in terms of the wear of the edge 622. The state of wear and the occurrence of leakage of toner due to the wear of each sample have been checked as a result of forming images on 100,000 sheets of paper. The ratio x of each sample is 0.25. The occurrence of leakage of toner has been determined by visually checking toner deposited on a larger surface of two surfaces of the cleaning blade 62 which form an acute angle with the photoconductor drum 31. The evaluation results of FIG. 6 show that an increase in the partial wear of the cleaning blade 62 and the occurrence of leakage of toner are observed when the edge hardness is 90 degrees or greater and that an increase in the wear of the entirety of the cleaning blade 62 and the occurrence of leakage of toner are observed when the edge hardness is 80 degrees or smaller.

Figure 6:
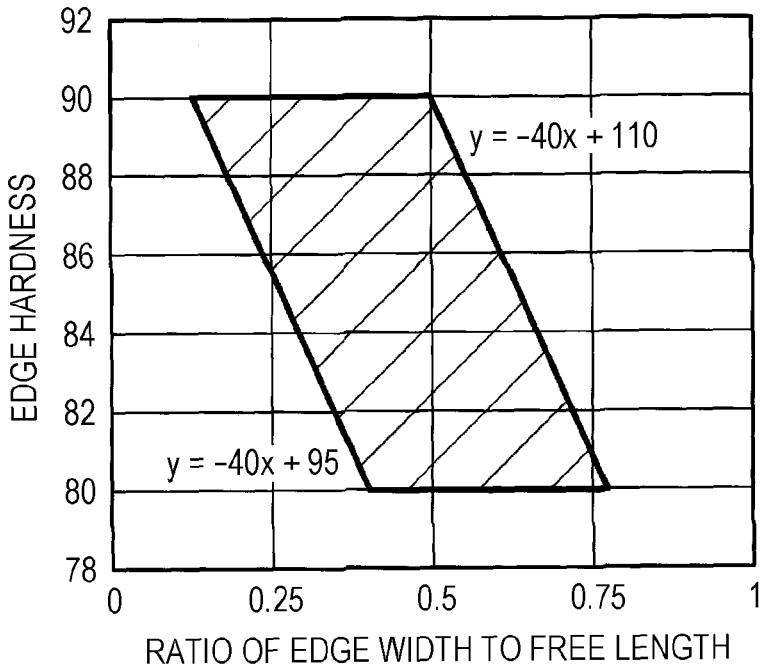
FIG. 6 is a graph illustrating the relationship between the hardness of an edge and the ratio of an edge width to a free length of a cleaning blade.

FIG. 6 is a graph illustrating the relationship between the edge hardness y and the ratio x of the edge width. In FIG. 6, the horizontal axis indicates the ratio x, and the vertical axis indicates the edge hardness y. The above-described three evaluation results show that a region indicated by a parallelogram illustrated in FIG. 6 may be a region where the uneven wear of the photoconductor drum 31, blade friction noise, and the wear of the edge 622 are all decreased. This region is a region where the ratio x and the edge hardness y satisfy all of the three conditions represented by the above-described expressions (1) through (3).

2. Modified Examples

An exemplary embodiment of the invention has been discussed. However, the invention is not restricted to the above-described exemplary embodiment and may be carried out in various other modes. Examples of other modes will be discussed below as modified examples. It is noted that the following various modified examples may be combined.

2-1. First Modified Example

The edge 622 of the cleaning blade 62 of the above-described exemplary embodiment has a rectangular shape on a lateral side. However, the configuration of the edge 622 is not restricted to this shape.

Figure 7:
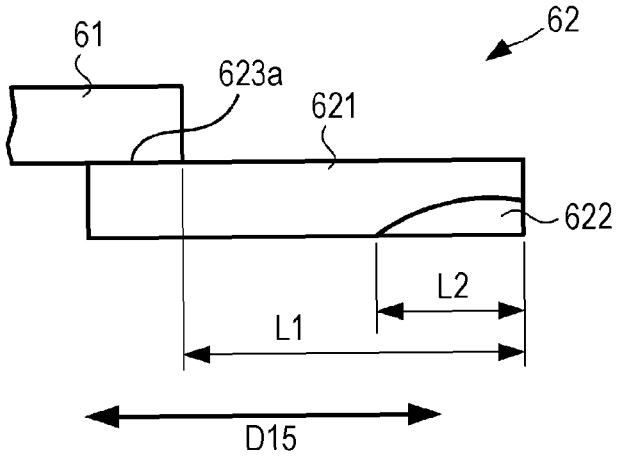
FIG. 7 illustrates a shape of a cleaning blade.

FIG. 7 illustrates a configuration of the cleaning blade 62 of a first modified example. In this modified example, the boundary between the edge 622 and the body 621 has a curved shape. The edge width L2 (width of the edge 622) is equal to a length of the longest portion of the edge 622 in the direction indicated by the bidirectional arrow D15.

2-2. Second Modified Example

In the above-described exemplary embodiment, the cleaning blade 62 cleans the surface of the photoconductor drum 31. A subject to be cleaned by the cleaning blade 62 (cleaning member) is not restricted to the photoconductor drum 31. A cleaning member of an exemplary embodiment of the invention may clean, for example, wheels. A subject may be cleaned as a result of being rotated, or may be cleaned in another manner.

2-3. Third Modified Example

The image forming apparatus 1 including the cleaning blade 62 is not restricted to the above-described tandem type, and may be another type, for example, a rotary type. The image forming apparatus 1 including the cleaning blade 62 is not restricted to an apparatus which forms an image by superposing plural colors of toner images, and may be an image forming apparatus which forms an image of a single color toner image. Additionally, an apparatus including the cleaning blade 62 is not restricted to an image forming apparatus.

The cleaning blade 62 of the above-described exemplary embodiment may be disposed in an electronic device other than an image forming apparatus. In the above-described exemplary embodiment, as a cleaning member which cleans a subject, the cleaning blade 62 which cleans the surface of the photoconductor drum 31 has been discussed. However, the cleaning member is not restricted to the cleaning blade 62, and may be a member which cleans a belt, a sponge roll, or a brush.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning member comprising:

a body that has rubber hardness of about 68 to 75 degrees, that is fixed to a support member at one end of the body, and that has a plate-like shape in which a corner portion of the body is missing; and an edge that is provided at the corner portion and fits into the corner portion, that is configured to contact a subject to be cleaned, and that has a thickness of about 0.1 to 1 mm, wherein the cleaning member satisfies the following conditions:

$$80 \leq y \leq 90;$$

$$y \geq -40x+95; \text{ and}$$

$$y \leq -40x+110$$

where x denotes a ratio of a length of the edge in a predetermined direction to a length of a portion of the body which is not fixed to the support member in the predetermined direction, and y denotes rubber hardness of the edge.

2. A developing device comprising:

an image carrier configured such that an electrostatic latent image may be developed on the image carrier by a developer including toner; and a cleaning member including:

a body that has rubber hardness of about 68 to 75 degrees, that is fixed to a support member at one end of the body, and that has a plate-like shape in which a corner portion of the body is missing; and an edge that is provided at the corner portion and fits into the corner portion, that is configured to contact a subject to be cleaned, and that has a thickness of about 0.1 to 1 mm, wherein the cleaning member satisfies the following conditions:

$$80 \leq y \leq 90;$$

$$y \geq -40x+95; \text{ and}$$

$$y \leq -40x+110$$

where x denotes a ratio of a length of the edge in a predetermined direction to a length of a portion of the body which is not fixed to the support member in the predetermined direction, and y denotes rubber hardness of the edge, and wherein the edge of the cleaning member is configured to contact a surface of the image carrier.

3. An image forming apparatus comprising:

an image carrier;

an exposure unit configured to expose the image carrier to light so as to form a latent image on a surface of the image carrier;

a developing unit configured to develop the latent image so as to form a toner image;

a transfer unit configured to transfer the toner image to a recording medium; and a cleaning member including:

a body that has rubber hardness of about 68 to 75 degrees, that is fixed to a support member at one end of the body, and that has a plate-like shape in which a corner portion of the body is missing; and an edge that is provided at the corner portion and fits into the corner portion, that is configured to contact a subject to be cleaned, and that has a thickness of about 0.1 to 1 mm, wherein the cleaning member satisfies the following conditions:

$$80 \leq y \leq 90;$$

$$y \geq -40x+95; \text{ and}$$

$$y \leq -40x+110$$

where x denotes a ratio of a length of the edge in a predetermined direction to a length of a portion of the body which is not fixed to the support member in the predetermined direction, and y denotes rubber hardness of the edge, and wherein the edge of the cleaning member is configured to contact the surface of the image carrier.

* * * * *